US007303357B2

(12) United States Patent
Villarreal et al.

(10) Patent No.: US 7,303,357 B2
(45) Date of Patent: Dec. 4, 2007

(54) CATCH BASIN HAVING SELECTABLE PORT POSITION

(76) Inventors: Arthur Villarreal, 851 N. Harvard Ave., Lindsay, CA (US) 93247; Chris M. Moralez, 851 N. Harvard Ave., Lindsay, CA (US) 93247; Robert Juskalian, 851 N. Harvard Ave., Lindsay, CA (US) 93247; Jerry Wright, 851 N. Harvard Ave., Lindsay, CA (US) 93247

( * ) Notice: Subject to any disclaimer, the term of this patent is extended or adjusted under 35 U.S.C. 154(b) by 123 days.

(21) Appl. No.: 11/345,504

(22) Filed: Feb. 1, 2006

(65) Prior Publication Data

US 2007/0177941 A1 Aug. 2, 2007

(51) Int. Cl.
*E02B 13/00* (2006.01)

(52) U.S. Cl. ..... 405/36; 405/62; 52/169.7; 404/2; 220/567.1

(58) Field of Classification Search ..... 405/52, 405/53, 36; 52/20, 169.7; 404/2–4; 220/567.1
See application file for complete search history.

(56) References Cited

U.S. PATENT DOCUMENTS 3,262,571 A * 7/1966 Petretti ..... 210/297
3,562,969 A 2/1971 Little, Jr.
3,695,153 A 10/1972 Dorris
4,345,998 A 8/1982 Graffis et al.
4,663,036 A * 5/1987 Strobl et al. ..... 405/52
D402,013 S 12/1998 Saffrey
5,849,181 A 12/1998 Monteith
6,112,935 A 9/2000 Shackelford
6,161,984 A 12/2000 Sinclair
6,419,421 B1 7/2002 Whitfield, Jr.
6,666,349 B1 * 12/2003 Gavin ..... 220/567.1
6,837,652 B1 1/2005 Rost et al.
7,040,838 B2 * 5/2006 Allard et al. ..... 405/36

OTHER PUBLICATIONS

National Diversified Sales, Inc., Drainage Products Catalog, pp. 8 and 16-25, Aug. 2005, US.

* cited by examiner

*Primary Examiner*—Frederick L. Lagman
(74) *Attorney, Agent, or Firm*—Fulwider Patton LLP

(57) ABSTRACT

A catch basin configured to allow selective positioning of the outlet and inlet ports on the side walls of the catch basin's receptacle body. At least one of the receptacle side walls comprise a slide opening having opposing sides. A slide member has a pair of slide edges that slidably engage the sides of the slide opening to substantially close the slide opening. The slide member has a port section and two or more positioning sections, with at least one positioning section located above the port section and one below the port section. The port section has an outlet or inlet port integral therewith or fixedly attached thereto or the port section comprises a mechanism for attaching an outlet or inlet port thereto, such as a port cutout having a removable knockout plate. The slide member has section removal indicators to identify which positioning sections should be removed.

29 Claims, 8 Drawing Sheets

CATCH BASIN HAVING SELECTABLE PORT POSITION

CROSS-REFERENCE TO RELATED APPLICATIONS

None.

BACKGROUND OF THE INVENTION

A. Field of the Invention

The field of the present invention relates generally to apparatuses utilized to drain areas of land. In particular, the present invention relates to catch basins having at least one inlet for receiving a fluid, such as storm water, and one or more outlets connected to a piping system, such as a storm sewer system, for transferring the fluid away from the catch basin. Even more particularly, the present invention relates to such catch basins that are configured to ease installation time, costs and effort by having selectable outlet and/or inlet port positions on one or more sides of the catch basin for connecting to a piping system.

B. Background

The use of one or more catch basins as a means of collecting and transferring fluid from an area of land is well known. In particular, the use of a catch basin positioned in the ground to collect and transfer storm water or other run-off water for transfer of that water to a storm sewer piping system is well known and commonly utilized in various landscape and similar applications. The typical catch basin comprises a main body portion or receptacle having a bottom section, side walls and an open top section that form a fluid chamber inside the main body portion. At least one of the side walls and/or the bottom section is configured with an outlet that connects to the piping system to drain water away from the catch basin. In one configuration, water enters the catch basin through a grate positioned across the top section. In another configuration, water also enters the catch basin through an inlet, which connects to a piping system that transfers water from an upstream location, on one or more sides of the main body portion. The grate is typically configured to screen solid materials, such as leaves and other debris, from entering the fluid chamber and the piping system, where it can clog the pipes and prevent collection and removal of the fluid. The outlet of the typical catch basin is positioned on the sidewall of the main body such that a sump area is provided at the bottom of the fluid chamber. The purpose of this sump area is to collect the smaller debris that passes through the grate to reduce the likelihood that this debris will clog the drain pipe. The main body portion can be configured in a variety of different cross-sectional shapes, with circular and square cross-sections being the most common configurations. The grate is typically of the same shape as the main body member and is configured to be removably attached to the top section thereof to permit the user to remove the grate and periodically clean out the sump area of the fluid chamber.

In one common application, a single catch basin is placed in the ground at the low spot of a lawn or other landscaped area or below a fluid down spout to collect storm water or excess water applied to the area. In this type of application, the catch basin is provided with a grate to allow water to flow into the fluid chamber, while screening out larger debris, and an outlet that connects to a sloped piping system to facilitate transferring the water away from the catch basin. This same configuration is also commonly utilized in driveways, parking lots and other paved or concreted areas. In another common application, the catch basin interconnects an inlet pipe, which receives fluid from another catch basin or through an inlet placed at a drainage area, and the drain pipe as a means of providing a cleanable sump area to prevent clogging of the drain pipe and, ultimately, the storm water or sewer drainage system. In either application, the catch basin grate and sump area must be periodically cleaned to prevent ponding of water on the landscaped area or in the street or parking lot. Some communities have regulations regarding the use and placement of catch basins so as to prevent the undesirable debris from entering the storm drainage or sewer system. Some communities have public or private services that periodically clean the sump area. In addition to preventing debris from entering and potentially clogging the storm drainage or sewer system, catch basins are also useful in minimizing the amount of pollutants that enter the storm drainage or sewer system. Absent the collecting of debris and pollutants at the catch basin, these materials are typically discharged to fresh or ocean waters, collected in detention basins or included in the water treated at a sewage treatment facility.

Installation of a catch basin involves selecting a catch basin having a fluid chamber of sufficient size to handle the expected amount of rainfall or other run-off, placing the catch basin at the low spot of the area to be drained or where excess water will accumulate, connecting the catch basin inlet to the inlet pipe (if applicable) and connecting the catch basin outlet to the drain pipe. The catch basin is usually placed in a hole deep enough for the main body member to be positioned such that the grate is substantially level or slightly below the surface of the ground. Typically, a gravel base or other firm base is provided in the hole for the catch basin to sit on. The catch basin inlet is connected to the inlet pipe, if applicable, and the outlet is connected to the drain pipe utilizing mechanisms appropriate for the materials utilized for the catch basin and inlet/drain pipes. Catch basins are commonly manufactured out of a structural plastic, such as injection-molded structural foam polyolefin or like material. Preferably, the outlet is positioned lower than the inlet to facilitate drainage of water from the catch basin. This may be accomplished by having the outlet lower on the side of the main body member than the inlet, utilizing a catch basin having a sloped bottom or by excavating the hole such that it slopes from inlet to outlet. Once the pipes are connected to the catch basin, the hole is filled in around the catch basin to secure the catch basin in place. For locations where vehicle traffic is expected, the hole around the catch basin may be filled with concrete or like material. Often, one or more holes are provided in the bottom section to allow excess water to leach out into the ground so as to prevent the accumulation of standing water in the catch basin.

The typical prior art catch basin is provided with a fixed outlet on one side of the main body that is sized to connect to a particular diameter of drainage pipe. If utilized, the inlet is typically, but not exclusively, placed at a fixed position on a sidewall opposite the outlet. Generally, the fixed outlets or inlets are located at or near the middle (top to bottom) of the sidewall. In some configurations, the outlet and/or inlet of the catch basin are provided with a universal outlet that is adapted to connect to a plurality of drain/inlet pipe diameters, thereby making the catch basin more universal. An example of such a configuration is shown in U.S. Pat. No. Des. 402,013 to Saffrey, the assignee of which is the assignee of the present invention. In other configurations, a universal outlet adapter connects to the outlet or inlet so as to permit connection to variable sized drain or inlet pipes. A problem with the aforementioned catch basins is that the outlets and/or inlets are fixedly positioned on the side wall of the main body portion. The fixed nature of these outlets/inlets makes installation of the catch basin and its connection to the drain or inlet pipes more difficult in that the installer has to carefully ensure that the catch basin is appropriately positioned relative to the outlet and inlet pipes. This generally requires somewhat careful consideration and preparation of the hole and bottom thereof so as to properly receive the catch basin.

An alternative to the use of a fixedly positioned catch basin outlet and/or inlet is the use of a series of knock-out locations on the side or sides of the main body portion. The knock-outs are typically configured in various positions down the sidewalls of the main body portion and are partially "pre-cut" to allow the installer to select the depth at which he or she desires to locate the outlet or inlet to better connect to the piping system(s). On common configuration for the cut-outs is the use of a bayonet cut, which facilitates an appropriately configured outlet or inlet, provided as a separate component, connecting to the cut-out and, therefore, the catch basin in a twist/lock fashion. Other configurations for the cut-outs are also possible. The outlet or inlet component can be provided as a single sized outlet/inlet for connecting to a particular sized outlet/inlet pipe or with a universal outlet/inlet adapter configured for multiple sizes of pipes (as described above). While the use of multiple positioned knockouts provides additional flexibility with regard to the placement of the outlet/inlet on the catch basin main body portion, they are known to have certain drawbacks. For instance, the installer has to be relatively careful when removing the knock-out that he or she does not damage the bayonet cut or sidewall of the catch basin, therefore generally rendering the subject catch basin useless for its intended purpose.

Several patents describe attempts to provide some flexibility for placement of the catch basin relative to the outlet or inlet piping system. For instance, U.S. Pat. No. 3,562,969 to Little, Jr. describes a sectional catch basin having pre-cast concrete walls that interlockingly fit onto a base and receive a cover. The walls have flanges that join together to form the receptacle. Spacer sections are utilized below or above a wall section to raise or lower the placement of the opening for the outlet and/or inlet. U.S. Pat. No. 6,419,421 to Whitfield, Jr. describes a catch basin comprised of a bottom piece, side plates, corner pieces and a top unit that are assembled on site. A lip on the bottom piece holds the corner pieces in place, the side plates slide into grooves in the corner pieces and the top unit connects to the corners pieces and side plates to form the receptacle. The side plates are shown with variable placed holes to connect the outlet and/or inlet pipes to the catch basin at the desired height. U.S. Pat. No. 6,161,984 to Sinclair describes a catch basin assembly that has components which allow the user to adjust the height of the assembly to allow for repaving of road surfaces or other need for an elevated height. Although the foregoing describe catch basin assemblies that allow some flexibility with regard to placement of the outlet and inlet pipes, they do not provide a catch basin pre-manufactured out of structural plastic that allows the on-site installer to make the necessary adjustments to the outlet and inlet locations.

What is needed is an improved catch basin that provides the desired flexibility for placement of the outlets and inlets along the depth of the main or receptacle body of the catch basin. The desired catch basin should allow the installer to relatively easily, and with low risk of damage to the catch basin, select the desired depth for placement of the outlet and, if appropriate, inlet into the fluid chamber thereof. The desired catch basin will have a locating mechanism that allows the installer to select the desired depth of the outlet/inlet along the sidewall of the main body portion without the use of tools or by only utilizing hand tools. The desired catch basin will be adaptable for use with a fixedly positioned outlets and inlets and/or with knock-outs for attachment of a separate outlet/inlet, whether of single size or universal adapter configuration.

SUMMARY OF THE INVENTION

The catch basin having selectable port position of the present invention provides the benefits and solves the problems identified above. That is to say, the present invention discloses a catch basin which is manufactured out of structural plastic materials and pre-made into the desired size and shape, which allows the on-site installer to select the most desirable or workable port position on the side wall of the catch basin for the outlet or inlet. The present invention is configured to allow the installer to easily and with low risk of damage to the catch basin select the height of the outlet or inlet. The catch basin of the present invention is adaptable for use with a fixed positioned outlets and inlets and/or with cutouts having removable knockouts configured for attachment of a separate outlet/inlet, whether of single size or universal adapter configuration. In one aspect of the present invention, the catch basin has a receptacle body comprising a plurality of side walls, a bottom and an open top section that define a fluid chamber inside the receptacle body. In the preferred embodiment, the side walls, bottom and top section of the receptacle body is substantially contiguous, forming a substantially unitary receptacle structure that can be manufactured out of a structural plastic material. A slide opening, having a pair of opposing slide opening sides, a slide insert and a slide stop, is located in at least one of the receptacle's side walls. A slide member, sized and configured to be received in the slide opening, has a pair of slide edges, a leading edge, a trailing edge, an inner wall face and an outer wall face. The slide edges of the slide member are configured to slidably engage the slide opening sides and substantially close the slide opening. In the preferred embodiment, the slide edges frictionally engage the slide opening sides. Also in the preferred embodiment, which is for a vertically configured slide opening and slide member, the bottom of the slide opening has a slide insert for receiving the slide member and the leading edge of the slide member abuts against a stop member at the top of the slide opening.

The slide member has a center or port section which is attached or attachable to an outlet or inlet port for connection to outlet or inlet piping systems. The port at or attachable to the port section of the slide member can be a single size port or a universal port configured for a plurality of different sized pipe connections. In one configuration, the outlet or inlet port is either integral to or fixedly attached to the port section of the slide member. In another configuration, the outlet or inlet port is a separate component that is attachable to the port section of the slide member. In a preferred configuration of this embodiment, the port section slide member has a slide port cutout with a removable slide knockout plate that is sized and configured to receivedly engage the separate outlet or inlet port. The slide port cutout can be a bayonet cut having a plurality of key ways that are configured to lockingly engage the keys of the separate inlet or outlet port member. In yet another configuration of the separate port embodiment, a variety of other mechanisms can be utilized for attaching the separate outlet or inlet port to the port section of the slide member, such as having a port member that slidingly engages a component on the slide member.

In addition to the port section, the slide member also has two or more removable positioning sections, with at least one of the positioning sections disposed above the port section and at least one of the positioning sections disposed below the port section. The positioning sections are configured to selectively position the port section, and therefore the outlet or inlet port, on the side wall of the receptacle. Preferably, each of the positioning sections are defined by a section cut in the slide member that defines an area of reduced thickness configured to facilitate the removal of the positioning section by snapping it off or by utilizing a utility knife. In the preferred configuration of the slide member, the inner and/or outer wall face thereof has one or more section removal indicators that are configured to identify which of the positioning sections should be removed to obtain the desired placement of the port section on the receptacle side wall.

In a second aspect of the present invention, the catch basin has a receptacle body with a first slide opening in a first side wall and a second slide opening in a second side wall. Each of the first and second side walls have slide openings that have opposing slide opening sides extending upwardly from a slide insert at the bottom to a slide stop near the peripheral collar at the top section of the receptacle. A first slide member is slidably received in the first slide opening and a second slide member is slidably received in the second slide opening. Each of the slide members has a port section configured with an inlet or outlet port integral or attached thereto or an inlet or outlet port attachable thereto. As set forth above, in a preferred embodiment, the slide members can have a slide port cutout with a removable knockout plate that receives a separate inlet or outlet component. In one configuration of this embodiment, the slide port cutout is configured as a bayonet cut having key ways that engage the keys of the separate inlet or outlet port component. Each of the slide members also have two or more removable positioning sections, with at least one of the positioning sections disposed above the port section and at least one of the positioning sections disposed below the port section. As described above, preferably the positioning sections are configured to allow the installer to relatively easily select the position of the port section on the receptacle side walls.

Accordingly, the primary objective of the present invention is to provide a catch basin that provides the advantages discussed above and overcomes the disadvantages and limitations which are associated with presently available catch basins.

An important objective of the present invention to provide a catch basin that allows the installer to quickly and easily selectively position the outlets and/or inlets on one or more sides of the catch basin receptacle body so as to align the outlets and/or inlets with a drainage or inlet piping system.

It is also an important objective of the present invention to provide a catch basin comprising a unitary, substantially contiguous receptacle body having at least one side with a slide opening configured to receive a slide member having either an outlet integral therewith or fixedly attached thereto.

It is also an important objective of the present invention to provide a catch basin comprising a unitary, substantially contiguous receptacle body having at least one side with a slide opening configured to receive a slide member having a knock-out plate and an outlet cutout, such as a bayonet cut having a plurality of key ways, adapted to engagedly receive an outlet therein.

It is also an important objective of the present invention to provide a catch basin having a receptacle body comprising at least a first side and a second side that each have a slide opening adapted to frictionally receive a slide member therein, the slide member for the slide opening on the first side adapted with or for receiving an outlet and the slide member for the slide opening on the second side adapted with or for receiving an inlet.

The above and other objectives of the present invention will be explained in greater detail by reference to the attached figures and the description of the preferred embodiment which follows. As set forth herein, the present invention resides in the novel features of form, construction, mode of operation and combination of processes presently described and understood by the claims.

BRIEF DESCRIPTION OF THE DRAWINGS

In the drawings which illustrate the preferred embodiments and the best modes presently contemplated for carrying out the present invention.

DETAILED DESCRIPTION OF THE PREFERRED EMBODIMENTS

Figure 1:
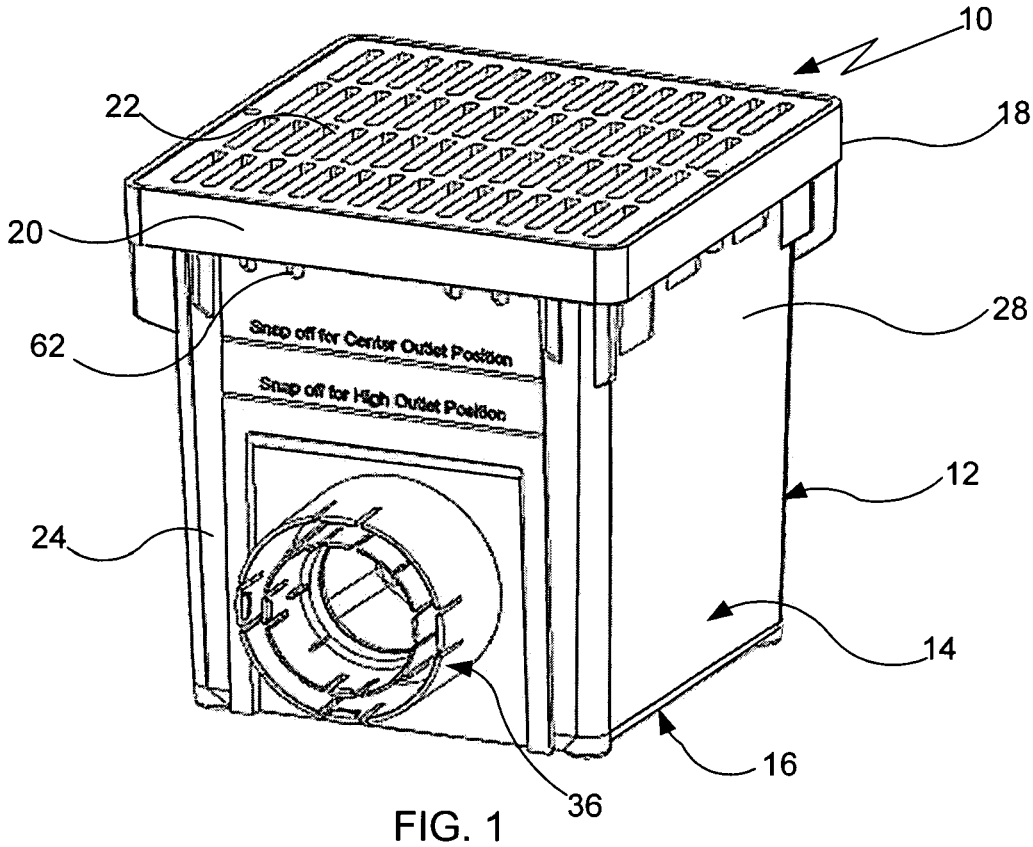
FIG. 1 is a perspective side view of the outlet side of a catch basin configured according to a preferred embodiment of the present invention having a grate mounted on the top section thereof.

With reference to the figures where like elements have been given like numerical designations to facilitate the reader's understanding of the present invention, the preferred embodiments of the present invention are set forth below. As is understood by those skilled in the art, the enclosed figures and drawings are merely illustrative of a preferred embodiment and represents one of several different ways of configuring the present invention. Although specific components, materials, configurations and uses are set forth below and illustrated in the drawings, it should be understood that a number of variations to the components and to the configuration of those components described herein and in the accompanying figures can be made without changing the scope and function of the invention set forth herein. For purposes of this disclosure, references are generally to use of the catch basin of the present invention with a landscape or other land-based drainage system, however, it is understood that the disclosure herein may apply to other types of uses where a catch basin can be beneficially utilized. In addition, references herein to an outlet or inlet ports can be generally be interchanged and is occasionally referred to generically as a port, that term being understood to encompass either an outlet or an inlet.

A catch basin that is manufactured out of the components and configured pursuant to a preferred embodiment of the present invention is shown generally as 10 in the figures. As shown in FIGS. 1 through 5, catch basin 10 generally comprises a receptacle body 12 having a plurality of substantially vertical side walls 14, a bottom 16 and an open top section 18, which is typically provided with a peripheral collar 20 sized and configured to removably support a grate 22. In the enclosed figures, receptacle body 12 is shown as having a generally square cross-sectional configuration with four side walls 14, including first side wall 24 and opposing second side wall 26 and third side wall 28 and opposing fourth side wall 30. Receptacle body 12 defines a fluid chamber 32 configured to receive fluid, such as runoff or other drainage water, through the slots or like openings in grate 22 and/or from inlet 34 on second side wall 26 and drain that fluid out through outlet 36 on first side wall 24. The area of fluid chamber 32 below outlet 36 serves as a sump to collect the small debris that passes through the openings in grate 22 to reduce the likelihood that this debris will flow into and possibly clog the drainage and/or storm sewer pipes, not shown, attached to outlet 36. Typically grate 22 removably attaches to collar 20 so that grate 22 can be taken off receptacle 12 and the debris deposited at the bottom of fluid chamber 32 removed. In the preferred embodiment of the present invention, receptacle body 12, inlet 34 and outlet 36 are made from a plastic material, preferably a structural plastic material such as a structural foam polyolefin or the like that can be injection molded into a single unitary component (best shown in FIGS. 6 and 9) and which is substantially ultraviolet resistant. Grate 22 can be made out of plastic where light vehicle traffic is anticipated or cast iron or steel where heavier loads are anticipated. Other materials, including brass and chrome, are also known to be suitable for receptacle 12 and/or grate 22. As is also known by those skilled in the art, receptacle body 12 can have a cross-sectional configuration that is different than the square shown in the figures (such as a round cross-section) and have side walls 14 that are not substantially vertical. Bottom 16 can be substantially planar or provided with a slope to assist in the transfer of fluid to outlet 36.

Figure 2:
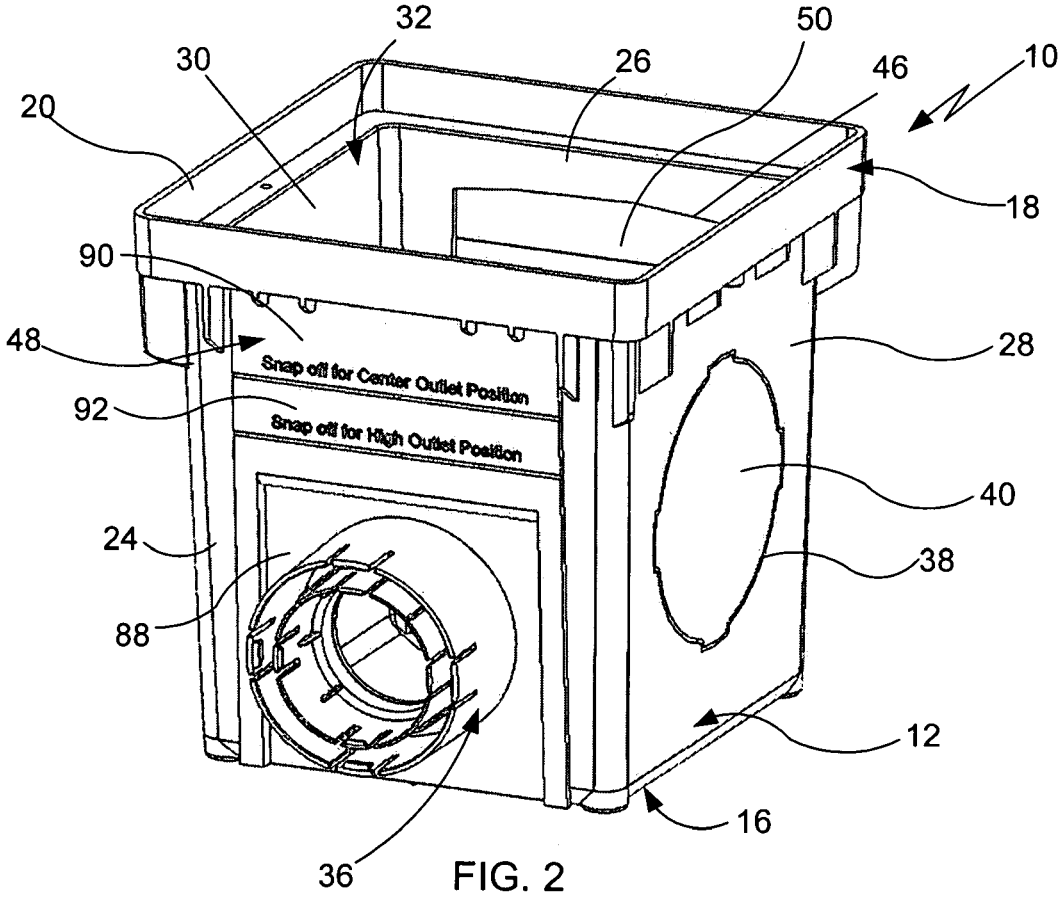
FIG. 2 is a perspective side view of the catch basin shown in FIG. 1 with the grate removed.
Figure 3:
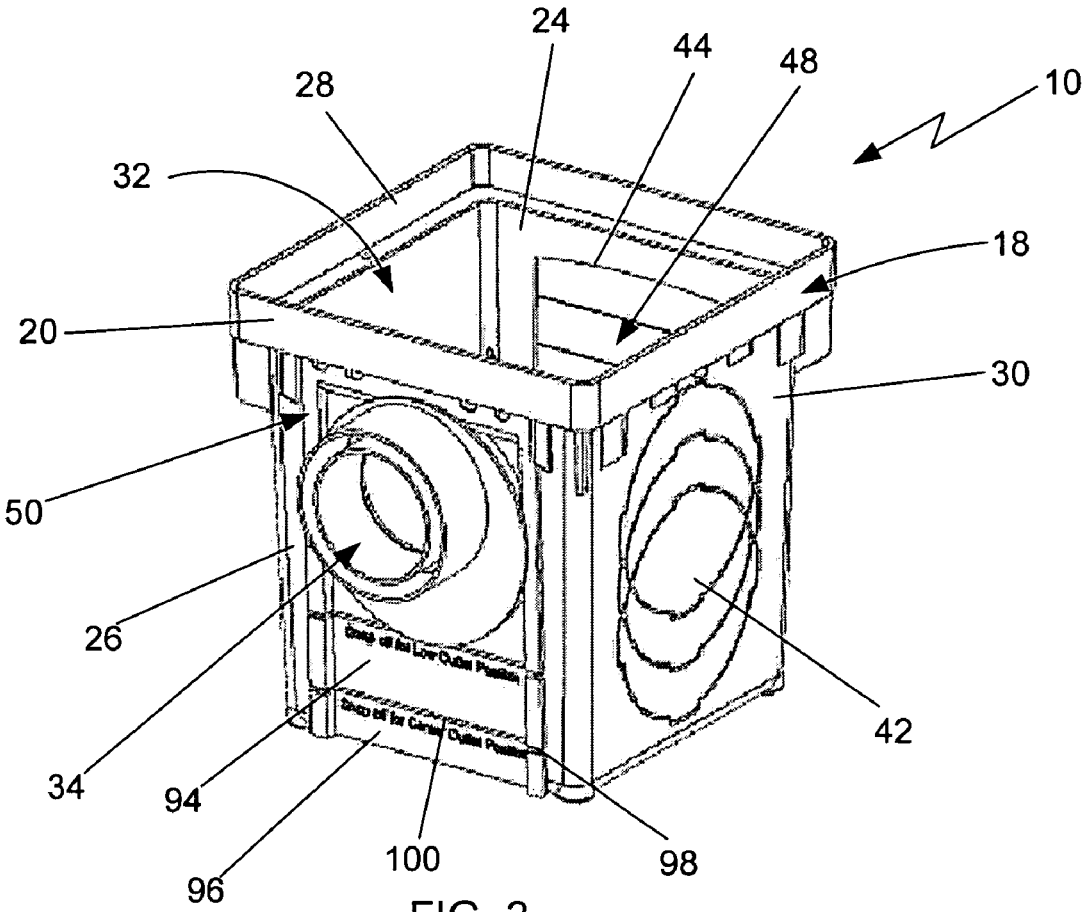
FIG. 3 is a perspective side view of the inlet side of the catch basin shown in FIG. 2.

Third 28 and fourth 30 side walls, as best shown in FIGS. 2 and 3 respectively, illustrate two of the prior art configurations discussed above for installation of outlet and inlet ports onto side walls 14. FIG. 2 shows use of a single port cutout 38 having a removable knockout plate 40 on third side wall 28. Port cutout 38 shown in FIG. 2 is configured in what is commonly referred to as a bayonet cut that receives an outlet 36 or inlet 38 in a generally twist and lock type of connection. As known to those skilled in the art, the outline of port cutout 38 is typically reduced in thickness so that the installer can relatively easily either push or knock out the knockout plate 40 or utilize a utility type of knife to cut out the knockout plate 40 along the outline of port cutout 38 to install either an outlet 36 or inlet 38. As discussed above, the disadvantage of this configuration is that the installer has no reasonable ability to alter the position of the outlet 36 or inlet 38. FIG. 3 shows use of a multiple port cutout 42 that provides some flexibility to the installer with regard to where he or she desires to place outlet 36 or inlet 38. In this type of configuration, the installer selects one of the three port cutout 42 locations and knocks or cuts out the knockout plate 40 prior to installation of outlet 36 or inlet 38.

Figure 6:
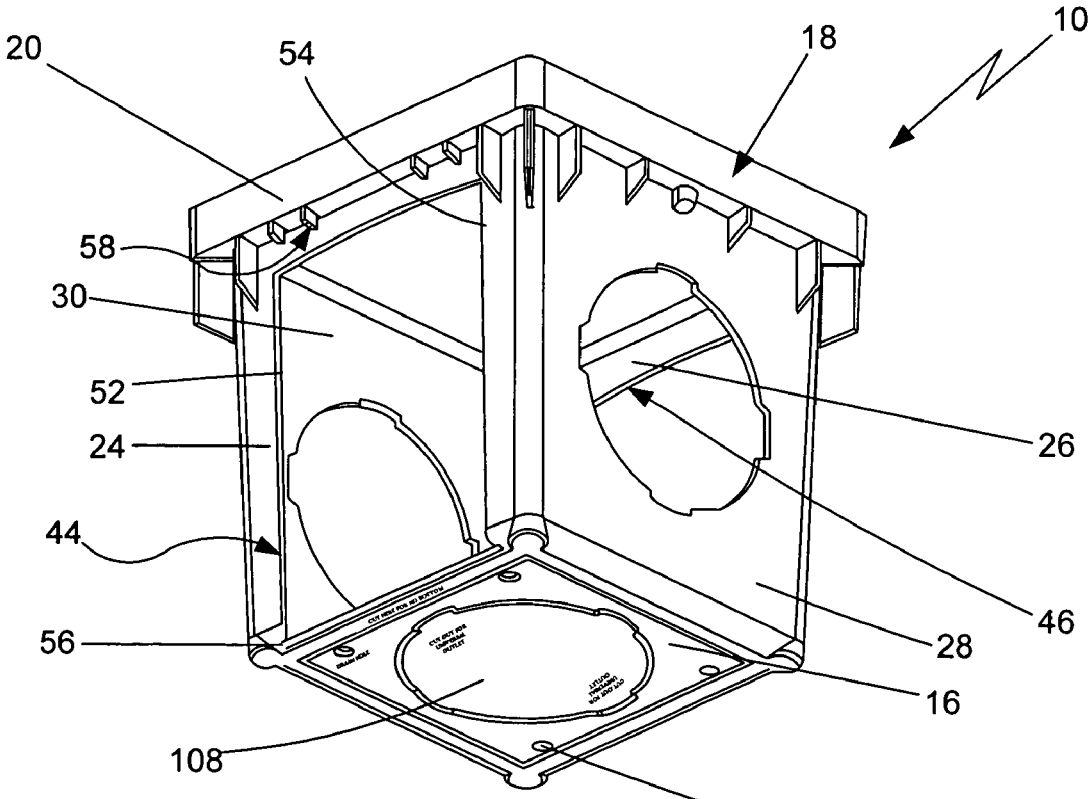
FIG. 6 is a bottom perspective view showing the catch basin of FIG. 2 with the first slide member removed from the slide opening on the first side of the receptacle body and the knockout plate removed from the third side wall.
Figure 7:
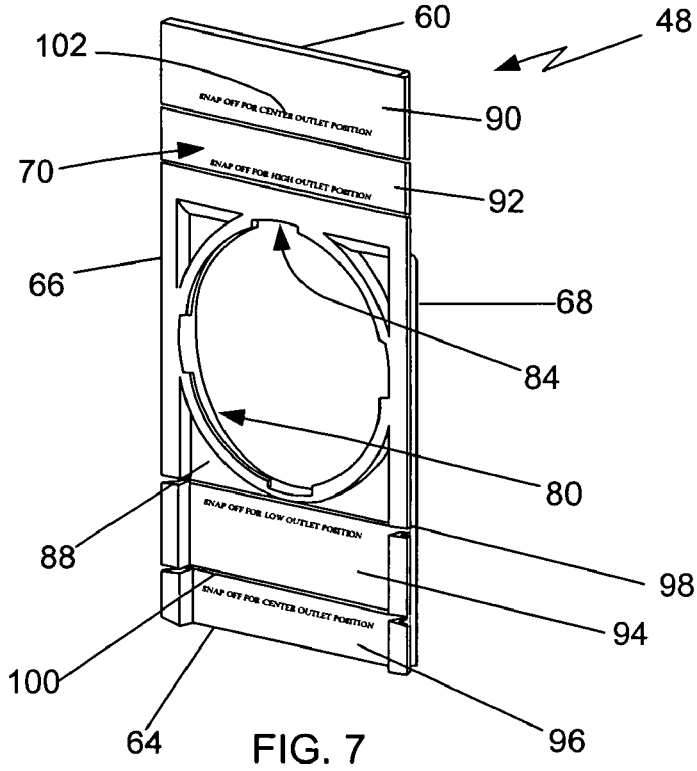
FIG. 7 is a perspective view of the outer wall face of the first slide member of FIG. 2 shown isolated from the receptacle body and with the knockout plate removed from the first slide member.
Figure 8:
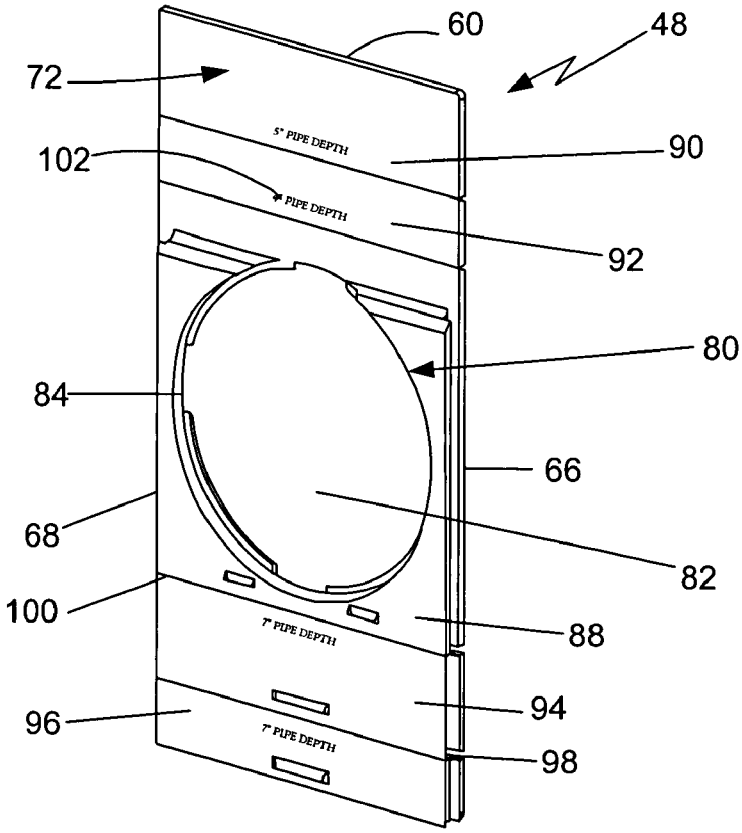
FIG. 8 is a perspective view of an alternative embodiment of the outer wall face of the first slide member showing the knockout plate in place in the first side member.

The present invention significantly improves the port, such as outlet 36 or inlet 38, positioning flexibility for the installer by utilizing an easier and more flexible port locating mechanism on one or more of the side walls 14 of receptacle 12. The figures show use of the present invention on first side wall 24 for outlet 36 and second side wall 26 for inlet 38. As those skilled in the art will readily appreciate, however, the placement of outlet 36 and inlet 38 can be on any of the sidewalls 14 of receptacle 12. In the preferred embodiment, shown in FIGS. 1 through 12, the present invention comprises a first slide opening 44 in first side 24 and second slide opening 46 in second side 26 (as best shown in FIG. 6 with knockout plate 40 on third side wall 28 removed). FIGS. 7 and 8 show, separate from catch basin 10, two embodiments of first slide member 48 configured to be installed in first slide opening 44, as discussed in more detail below. FIGS. 2 and 3 best show first slide member 48 and second slide member 50, respectively, installed in first slide opening 44 and second slide opening 46. First 44 and second 46 slide openings are configured with opposing slide opening sides 52 and 54, slide inlet 56 and slide stop 58, as best shown with regard to first slide opening 44 in FIG. 6. Slide inlet 56 is configured to receive the leading edge 60 of slide member 48 or 50 and slide stop 58 is configured to prevent further upward motion of slide member 48 or 50 by having leading edge 60 abut against slide stop 58. In the embodiment shown in FIGS. 1 through 13, slide stop 58 is merely the collar supports 62 on the lower side of collar 20 used to provide stability for receptacle body 12 and support grate 22. In the embodiment shown in FIG. 14, slide stop 58 is configured to receive leading edge 60 of slide member 48 or 50 therein.

Figure 4:
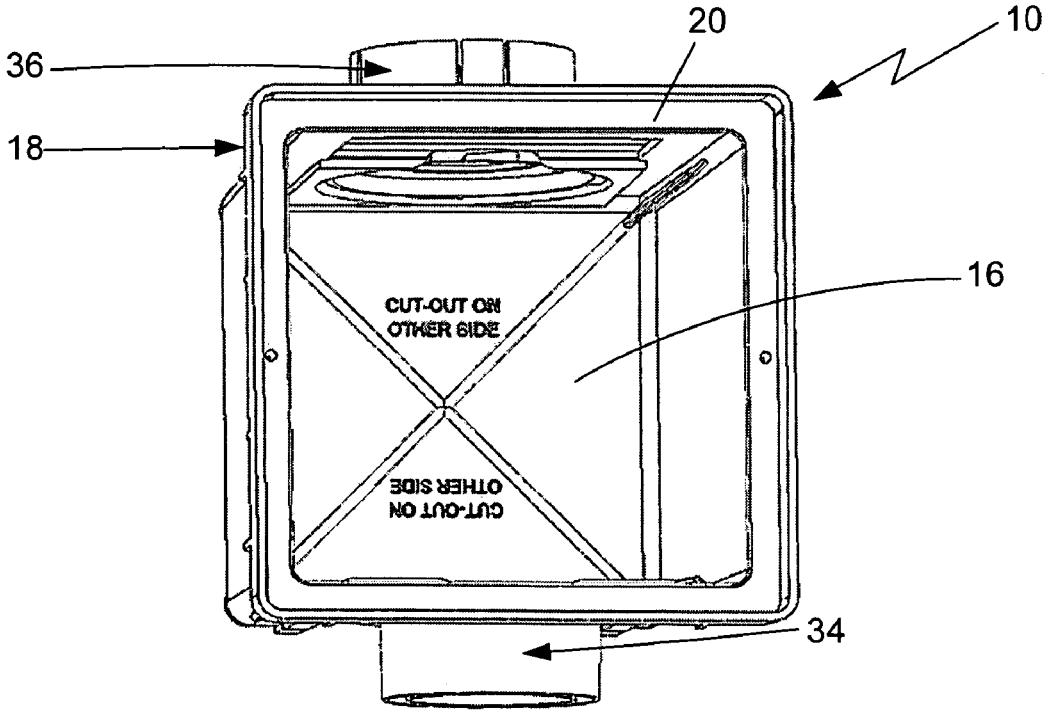
FIG. 4 is a top perspective view of the catch basin shown in FIG. 2.
Figure 5:
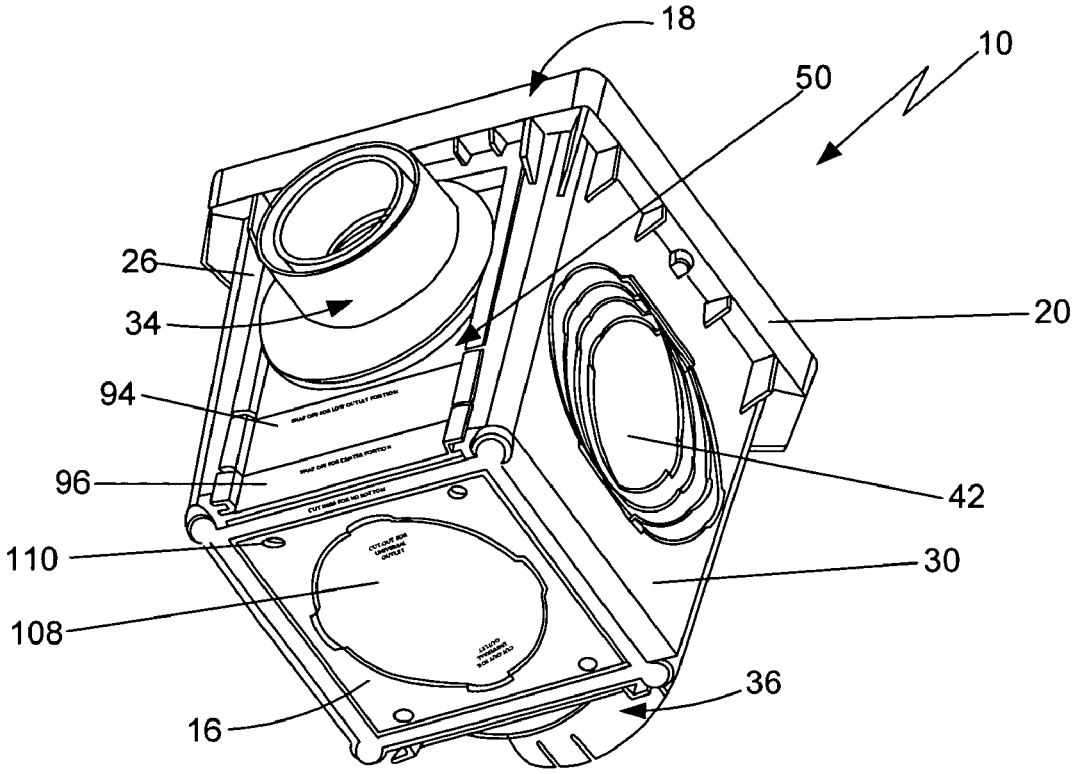
FIG. 5 is a bottom perspective view of the catch basin shown in FIG. 2.
Figure 13:
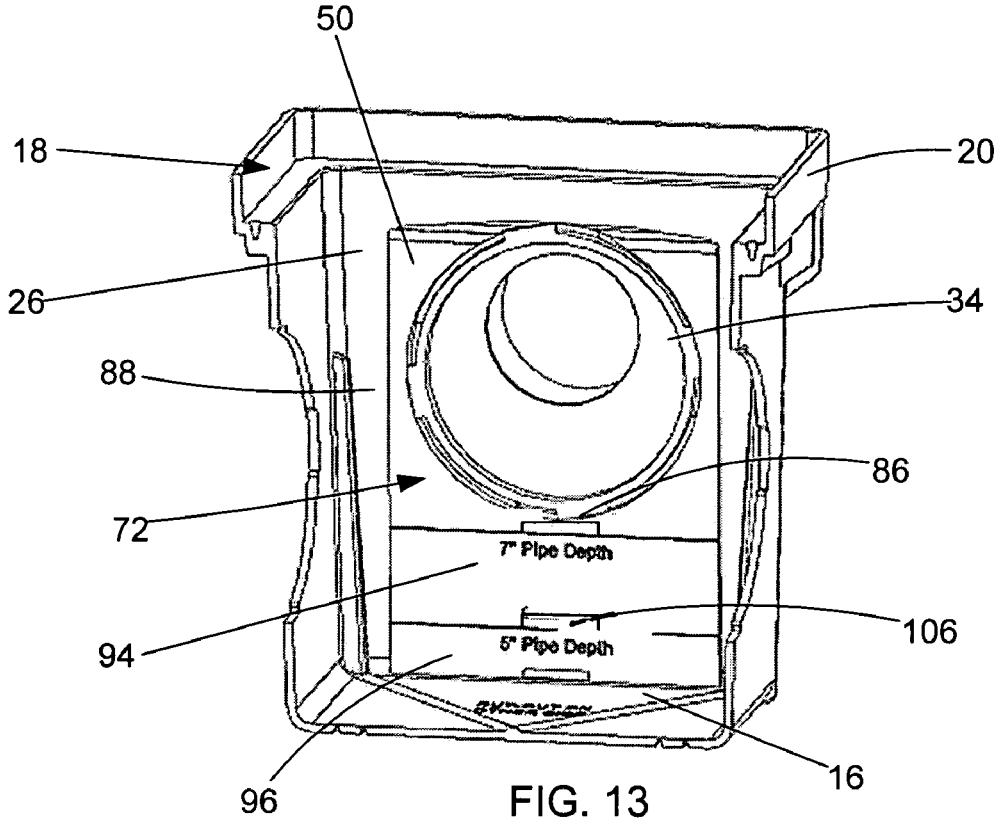
FIG. 13 is a perspective view of the inner wall face of the slide member, with the inlet in place, installed in the second side of the receptacle body.
Figure 14:
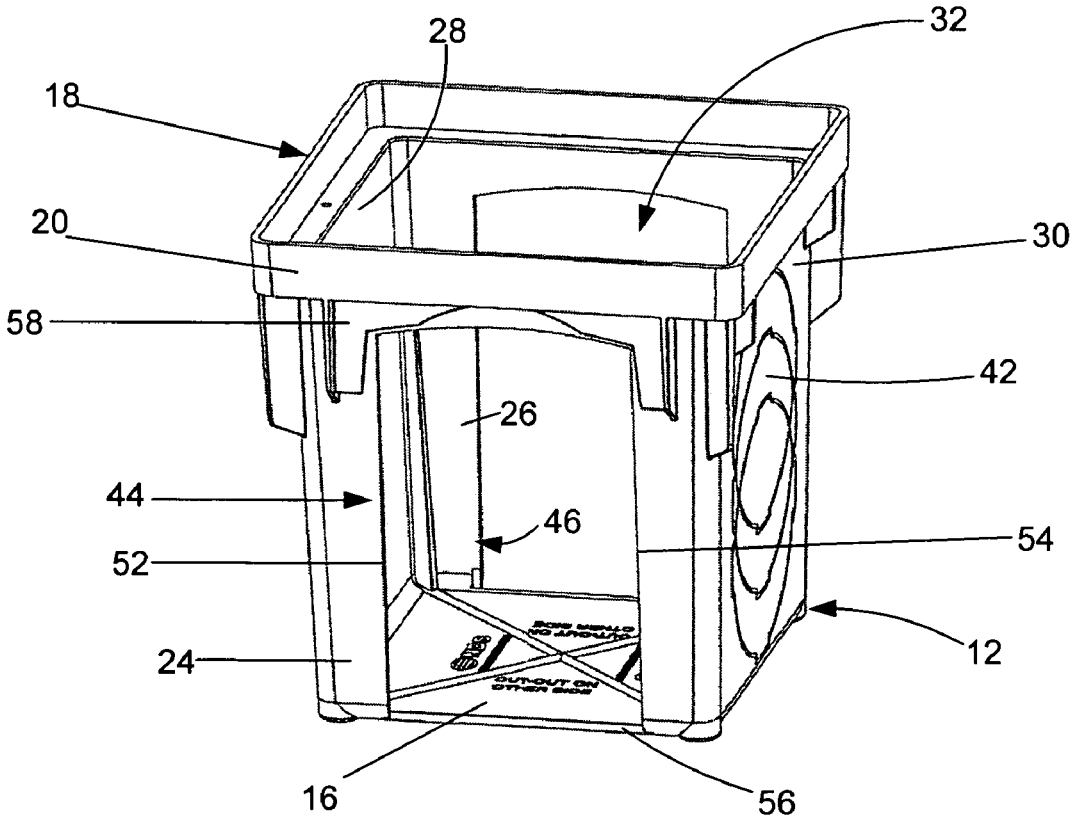
FIG. 14 is a perspective view of a catch basin configured according to an alternative configuration of the present invention showing a modified slide stop for receiving the leading edge of a slide member.

As best shown in FIGS. 4, 7 and 13, each of slide members 48 and 50 have leading edge 60, trailing edge 64, slide edges 66 and 68, outer wall face 70 and inner wall face 72. As utilized herein, leading edge 60 of slide members 48 and 50 is the forward or front edge of slide members 48/50 and trailing edge 64 is the rearward or back edge of slide members 48/50 as they are slid into position in first 44 and second 46 slide openings. In the embodiment shown in the figures, leading edge 60 is the top edge and trailing edge 64 is the bottom edge (i.e., on the substantially vertical side walls 24 and 26). As also utilized herein, outer wall face 70 is that side of slide members 48 and 50 which faces outward from receptacle body 12 when slide members 48 and 50 are in slide openings 44 and 46, respectively, and inner wall face 72 is that side which faces in towards fluid chamber 32 when slide members 48 and 50 are in slide openings 44 and 46. In the preferred embodiment, as best shown in FIGS. 2 and 3, when first slide member 48 is received in first slide opening 44 and second slide member 50 is received in second slide opening 46, the fluid chamber 32 is substantially closed. As explained in more detail below, slide edges 66 and 68 of slide members 48 and 50 are cooperatively configured to be received in slidable engagement with slide opening sides 52 and 54 of slide openings 44 and 46. In this configuration, slide members 48 and 50 are slid into slide openings 44 and 46, respectively, at slide inlets 56 and slid along slide opening sides 50 and 52 until the leading edge 60 abuts slide stop 58.

Figure 15:
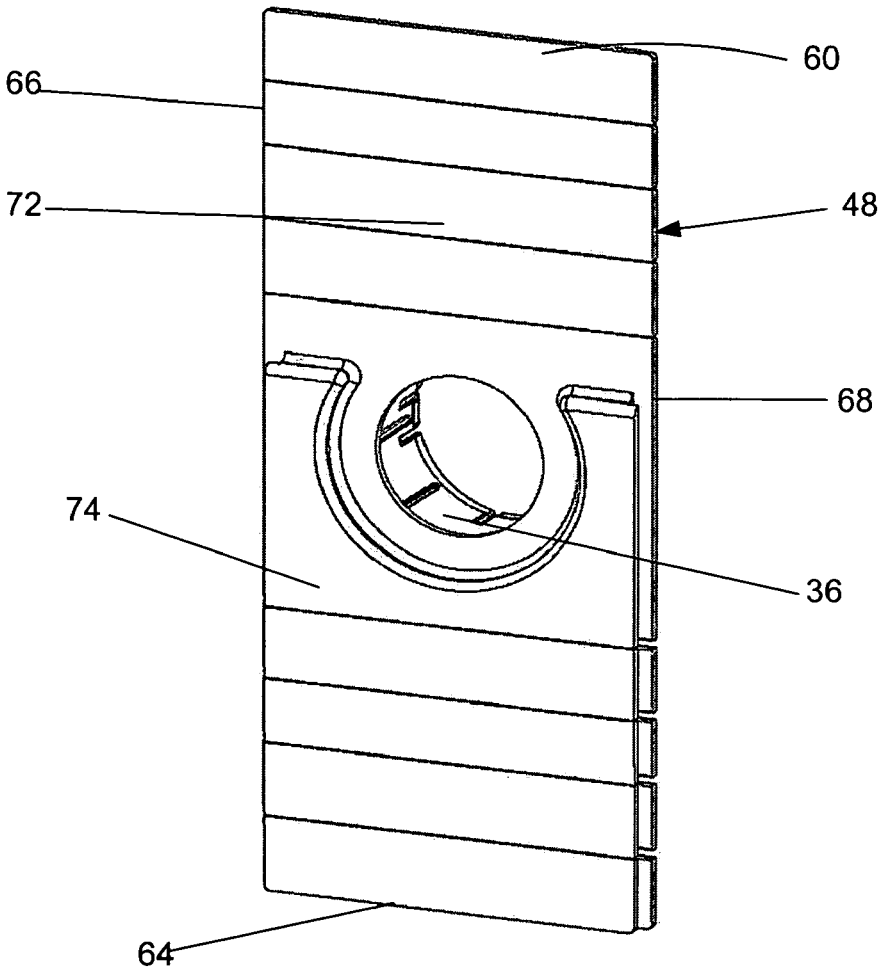
FIG. 15 is a perspective view of the inner wall of a slide member for use with the catch basin of the present invention showing the use of a slide engagement member to slidably engage the sides of the slide openings.
Figure 16:
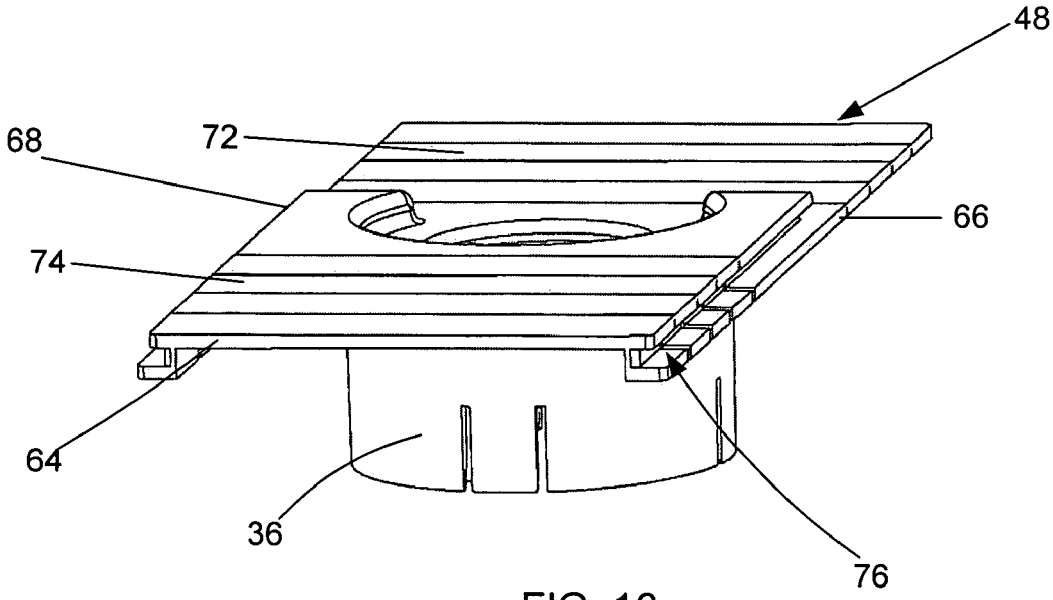
FIG. 16 is an end perspective view from the trailing edge side of the slide member of FIG. 15 showing the groove-like structure formed to engage the sides of the slide openings.
Figure 17:
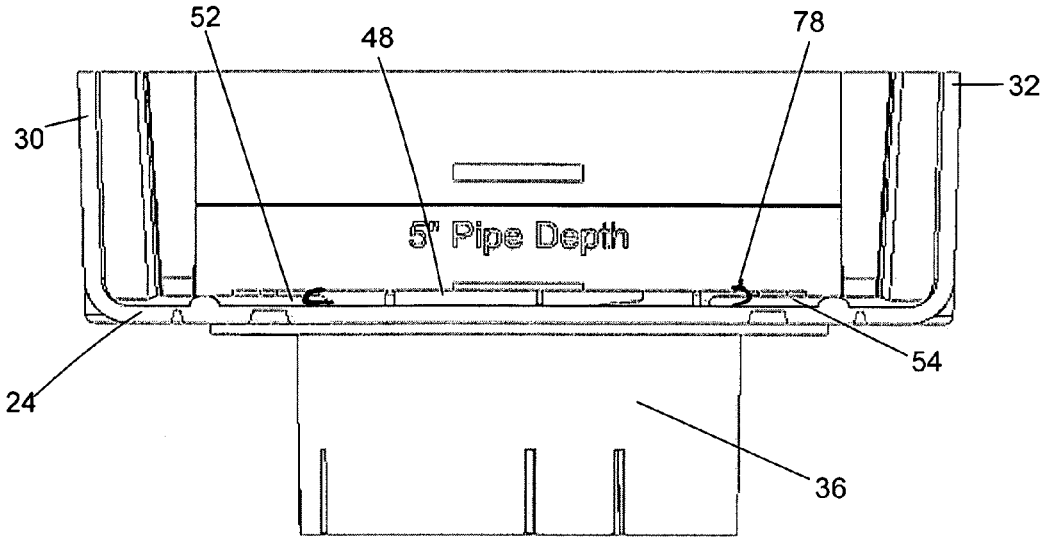
FIG. 17 is a top view of the first side wall configured with a slide member that slides in from the top and engages groove structures on the sides of the first slide opening.

Numerous configurations are possible to obtain the desired slidable engagement of slide members 48 and 50 with slide openings 44 and 46. In a preferred embodiment, inner wall face 72 comprises a slide engagement member 74, best shown in FIGS. 4, 15 and 16, on at least the lower half of slide members 48 and 50 that forms a groove-like structure 76 (FIG. 16) at the slide edges 66 and 68 that slidably engages the slide opening sides 52 and 54. Preferably, the groove-like structure is sized and configured to frictionally engage the slide opening sides 52 and 54 as slide members 48 and 50 are slid into place at first 44 and second 46 slide openings. In an alternative configuration, shown in FIG. 17, the sides 50 and 52 of the slide openings 44 and 46 have a groove structure 78 in which slides the slide edges 66 and 68 of slide members 48 and 50, such as that shown for first slide member 48 in groove structure 78 of first slide opening 44 in FIG. 17. As with the embodiment of FIGS. 15 and 16, it is preferred that the groove structure 78 and the slide edges 66 and 68 are cooperatively configured such that slide members 48 and 50 are frictionally received in slide openings 44 and 46.

Outlet 36 and inlet 34 can be manufactured integral with first 48 and second 50 slide members, as shown in FIGS. 1 through 3, 15 and 16, or a separate component that is fixedly attached to first 48 and second 50 slide members or slide members 48 and 50 can comprise a slide port cut-out 80, such as best shown in FIGS. 7 through 12 (which can be either or both a slide outlet cutout or a slide inlet cutout depending on the port to be utilized therewith). In the integral embodiment of the present invention, outlet 36 and inlet 34 can be molded or otherwise manufactured with slide members 48 and 50. As with each of these embodiments, outlet 36 and inlet 34 can be a configured for a single size of inlet or drainage piping or they can be configured as a "universal" adapter for various sizes of pipes (such as shown in U.S. Pat. No. Des. 402,013 to Saffrey). If manufacturing costs are excessive to mold slide members 48 and 50 with outlet 36 and/or inlet 34, then these components can be manufactured separately and fixedly attached with adhesives, sonic welding or other mechanisms suitable for the materials utilized for slide members 48/50 and outlet 36 and inlet 34. In another preferred embodiment, slide members 48 and 50 can include slide port cutout 80, best shown in FIGS. 7 and 8, sized and configured to engagedly receive an inlet 34 or outlet 36, as shown in the installation sequence of FIGS. 9 through 12 for inlet 34. Slide members 48 and 50 can be provided with an open slide port cutout 80, as shown in FIG. 7, or with a slide knockout plate 82 disposed therein, as shown in FIG. 8. As well known in the art, the periphery of slide port cutout 80 can be cut, molded or otherwise configured to have a thickness that is reduced relative to the area around the slide port cutout 80 so the installer can knock out the slide knockout plate 82 or utilize a utility knife or other cutting tool to remove the slide knockout plate 82 to provide the open slide port cutout. In this manner, the installer can make the decision during the installation process whether another port is necessary for an inlet 34 or outlet 36 or if the slide knockout plate 82 should remain in place to block any flow out of the receptacle body 12 at the side wall(s) 14 where the slide member 48 or 50 is located. Slide port cutout 80 can be configured in a number of different ways known in the art that are suitable for connecting, preferably in an engagedly manner, with inlet 34 or outlet 36. For instance, as shown in the figures, slide port cutout 80 can have what is commonly referred to as a bayonet cut having a plurality of key ways 84, such as the four shown in FIG. 7, that are configured to engage a like number of keys 86 on the receptacle side of the inlet 34 or outlet 36, such as shown in FIG. 13 for inlet 34. During installation, keys 86 of inlet 34 or outlet 36 are received in the key ways 84 of the slide port cutout 80 on first 48 or second 50 slide member and then the inlet 34 or outlet 36 is rotated to lock the inlet 34 or outlet 36 in place. If desired, an adhesive compound or other material may be utilized to further secure the inlet 34 or outlet 36 in place. Various other configurations for slide port cutout 80 can provide the same or similar installation benefits as described above for the bayonet cut shown in the figures.

Figure 11:
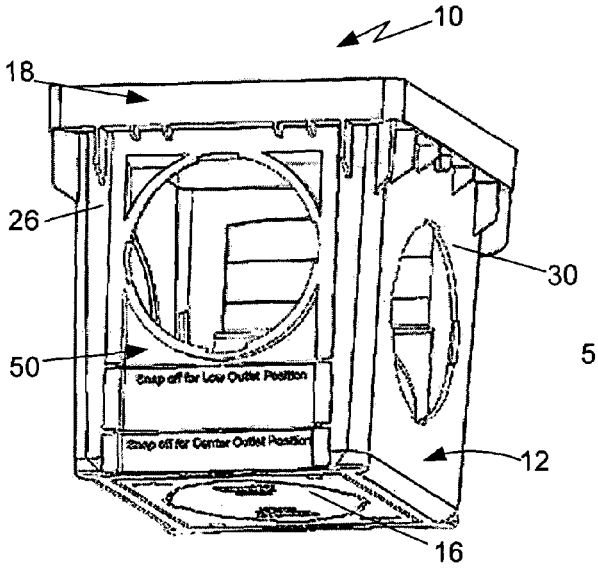
FIG. 11 is a perspective view of the catch basin of FIG. 10 showing the slide member fully placed into the slide opening.
Figure 12:
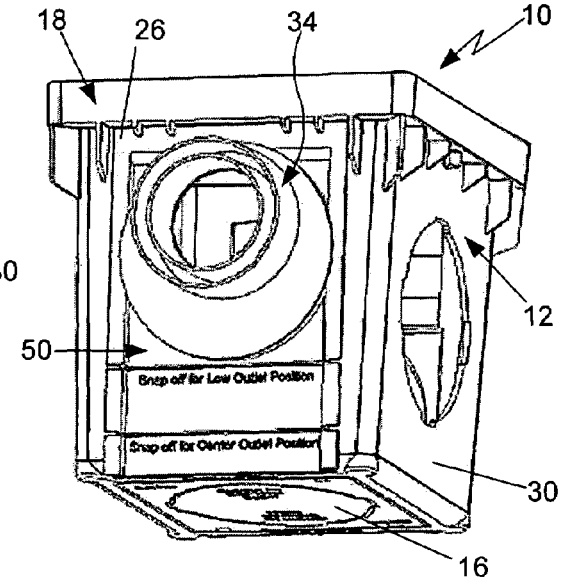
FIG. 12 is a perspective view of the catch basin of FIG. 11 showing the inlet placed into the open inlet cutout.

To provide for the selectable positioning of inlet 34 or outlet 36, the slide members, such as first 48 and second 50 slide members, of the preferred embodiment of the present invention utilize a port section connected to two or more separatable positioning sections, such as the first positioning section 90, second positioning section 92, third positioning section 94 and fourth positioning section 96 shown in FIGS. 7 and 8. In the embodiments shown in the figures, first 90 and second 92 positioning sections are located above (relative to the vertically disposed slide members 48 and 50) port section 88 and third 94 and fourth 96 positioning sections are located below the port section 88 to allow adjustment of inlet 34 or outlet 36 up or down relative to the side wall 14 of receptacle body 12. Although four positioning sections are shown in the figures, those skilled in-the art will understand that any number of appropriately sized positioning sections may be utilized. For usefulness purposes, a minimum of one positioning section is required above port section 88 and one is required below port section 88. During installation of the embodiment shown in the figures, the installer selectively removes none, one or both of upper sections, first 90 and second 92 positioning sections, and/or none, one or both of the lower sections, third 94 and fourth 96 positioning sections, to place inlet 34 or outlet 36 in the desired location on first 24 or second 26 side wall. In the configuration shown in the figures, the installer must remove two, but only two, of the positioning sections to provide a first 48 or second 50 slide member that fits within first 44 or second 46 slide opening. As an example, in the installation sequence shown in FIGS. 9 through 12 the first 90 and second 92 positioning sections have been removed from second slide member 50 so that inlet 34 can be placed in the uppermost position on second side wall 26, as shown in FIG. 12. To facilitate removal of the appropriate positioning sections, each positioning section is separated from an adjacent positioning section or the port section 88 by a section cut 98 that provides an area of reduced thickness 100 that is configured to allow the installer to relatively easily break or cut off the unneeded positioning section (i.e., the first 90 and second 92 positioning sections for the use shown if FIGS. 9 through 12). As known to those skilled in the art, section cut 98 and the area of reduced thickness 100 is preferably provided during the manufacturing process, such as during the injecting molding of first 48 and second 50 slide members. Alternatively, depending on the materials utilized for the slide members 48/50, the section cut 98 and area of reduced thickness 100 can be provided after the initial molding by cutting or otherwise removing an appropriate amount of material from first 48 or second 50 slide members.

Figure 18:
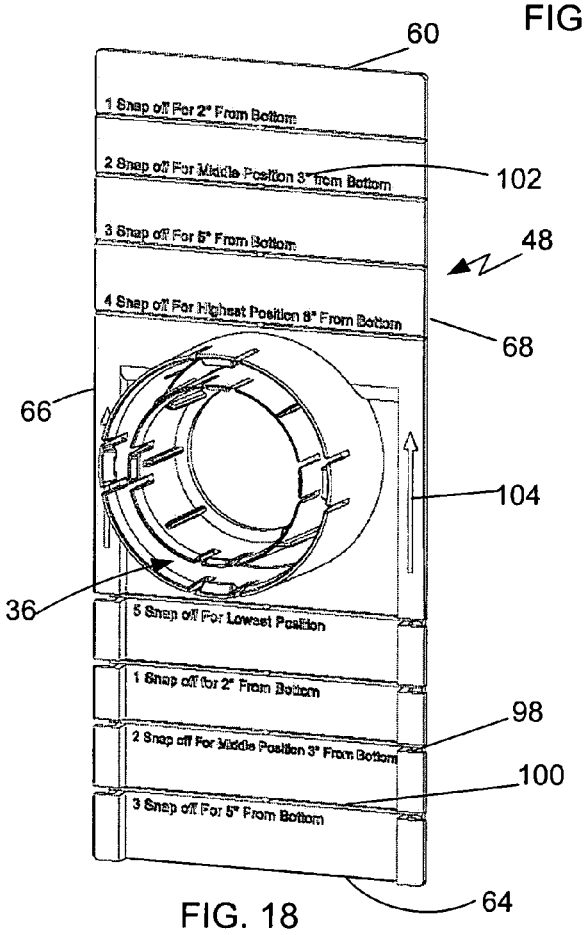
FIG. 18 is a perspective view of a slide member configured with an attached universal adapter outlet for use with the catch basin of the present invention showing use of alternative wording for the section removal indicators.

To assist the installer with removal of the proper positioning sections, the preferred embodiment of the present invention utilizes a section removal indicator 102 at each of the positioning sections 90, 92, 94 and 96, as best shown in FIGS. 7 and 8. Generally, the section removal indicators will comprise a written and/or numeric message that indicates to the installer which positioning section he or she must remove for the selected port position. For instance, in FIG. 7 the position indicators 102 state the depth from the top of the receptacle body 12 that the inlet or outlet pipe is located and which the inlet 34 or outlet 36 on first 48 or second 50 slide member will be located at to be substantially aligned with the inlet/outlet pipe. In FIG. 8 the position indicators 102 inform the installer which section he or she must snap off for placement of inlet 34 or outlet 36 at the low, center or high positions. In an embodiment shown in FIG. 18, the position indicators 102 inform the installer of which positioning section to snap off for the high/low position and the distance from the bottom. The embodiment of FIG. 18 also utilizes an arrow 104 to indicate which direction the slide member is inserted into slide inlet 56 during installation.

To assist with placement of first 48 or second 50 slide member inside first 44 or second 46 slide openings, the inner wall face 72 can comprise one or more tab members 106 on port section 88 and each of the lower positioning sections, such as third positioning section 94 and fourth positioning section 96 shown in FIG. 13. Tab members 106 are sized and configured to engage bottom 16 of receptacle body 12 so as to support the slide members in the slide openings, such as second slide member 50 in second slide opening 46 shown in FIG. 13. In a preferred embodiment, tab members 106 are configured to rest on and be supported by bottom 16. Tab members 106 are only necessary for the port section 88 and lower positioning sections 94 and 96, with the tab member 106 being used when the port section 88 is placed at the lowest position, as configured for outlet 36 in FIG. 2.

Bottom 16 can be configured to be substantially planar or with an sloped surface to facilitate drainage through outlet 36. In addition, bottom 16 can be a solid component or, as best shown in FIG. 6, comprise a removable bottom port cutout 108 for connection to an outlet 36. In the preferred embodiment, bottom port cutout 108 is configured with the same type of bayonet-style cutout as described above. In addition, bottom 16 can comprises one or more knockout drainage holes 110 that, if desired, the installer can open to allow fluid to drain downward from fluid chamber 32 to prevent problems with standing water inside the otherwise substantially sealed catch basin 10. Preferably, the periphery of the drainage holes is partially cut to allow relatively easy knockout or cutting away of the material from bottom 16 to provide the openings for drainage holes 110. As with the other inlet/outlet connections, bottom port cutout 108 can be provided in a variety of different configurations.

Figure 9:
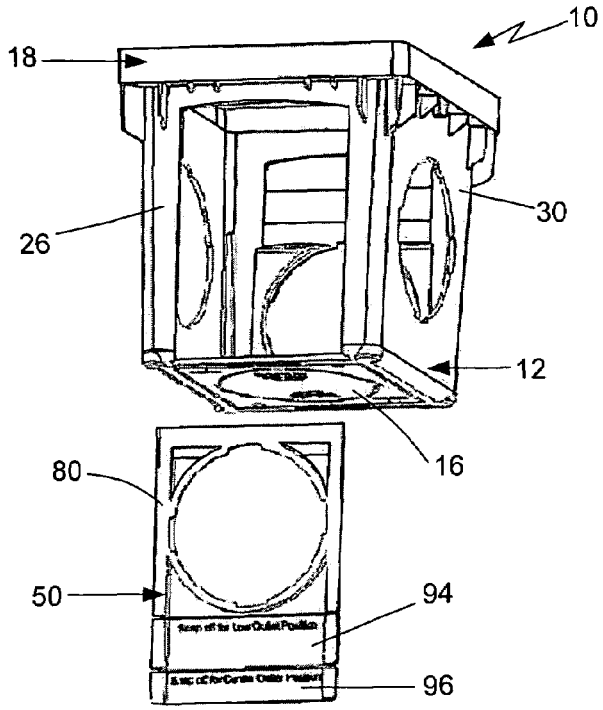
FIG. 9 is a perspective view of a catch basin configured according to the principles of the present invention showing a slide member, with the knockout plate removed, positioned to slide into the slide opening on the second side of the receptacle body.
Figure 10:
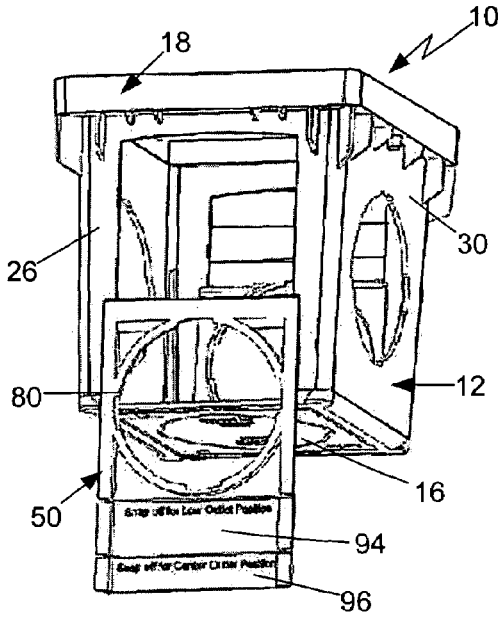
FIG. 10 is a perspective view of the catch basin of FIG. 9 showing the slide member at the slide insert area of the slide opening as the slide member is being slid into the slide opening.
Figure 19:
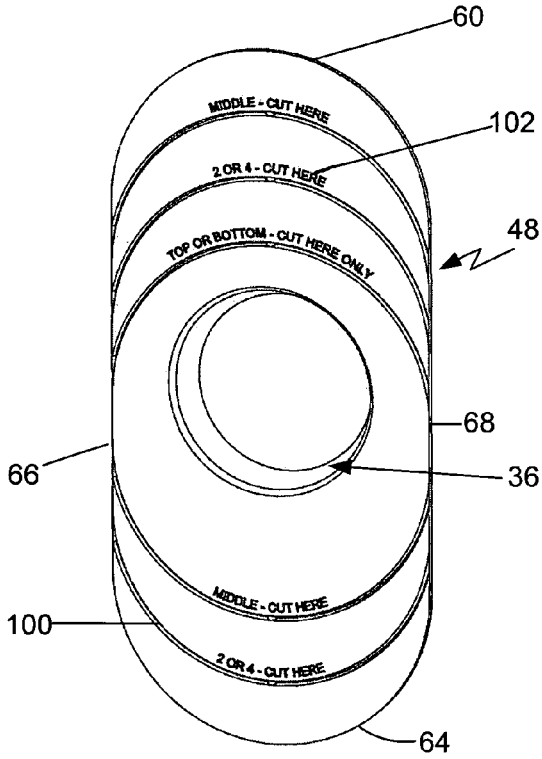
FIG. 19 is a perspective view of a slide member configured in an oblong shape and a slip ring port for use with the catch basin of the present invention.

Although receptacle body 12 is shown as substantially square and slide openings 44/46 and slide members 48/50 are shown as rectangular, those skilled in the art will readily understand that the invention is not so limited. As stated above, receptacle body 12 can be of a variety of different cross-sectional configurations and incorporate the principles and benefits of the present invention. Additionally, even for square receptacle body 12, slide openings 44/46 and slide members 48/50 can be configured with different configurations. For instance, as shown in FIG. 19, slide members 48 and 50 can be provided in a generally oblong or oval configuration to match a like configured slide opening 44 and 46 (not shown). In addition, as also shown in FIG. 19 for outlet 36, the inlet or outlet port connection can be a slip ring type of configuration. An additional modification to the catch basin 10 that is within the scope of the present invention pertains to the interaction between slide members 48/50 and slide openings 44/46 on side walls 24, 26, 28 and/or 30. As will be readily understood by those skilled in the art, although the figures included herewith show slide members 48 and 50 sliding onto receptacle body 12 from slide inlet 56 generally disposed at or near the bottom 16 thereof, such as illustrated by FIGS. 9 through 11, catch basin 10 can also or alternatively be configured for slide members 48/50 to slide into position from a slide inlet 56 generally positioned at slide opening sides 52 or 54 or at or near top section 18. For a side entering slide member 48/50, slide inlet 56 would be located at one of slide openings sides 52 or 54 with a slide stop 58 positioned at or near slide opening sides 52 or 54 to engage slide edges 66 or 68. For a top entering slide member 48/50, the stop member 58 is positioned at or near bottom 16 to edge 64 (though identified as the trailing edge in above, it would become the leading edge in a slide from the top configuration) of slide members 48/50. Top section 18 and collar 20 may need to be modified as appropriate for either side or top entering slide members 48/50.

In use, the installer will excavate an appropriately sized hole and, typically, place gravel or other fill material at the bottom thereof for placement of catch basin 10. The receptacle body may be supplied with one or more side walls configured to accept an appropriately sized and configured slide member therein, typically two opposing sides such as first side wall 24 and second side wall 26. In an installation having no inlet pipes, the inflow of fluid being through the grate, the installer will align the catch basin with the drainage pipe and select a first slide member 48 either already having the desired outlet 36 installed (i.e., if integral or fixed thereto) or a cutout 80, in which case the installer removes knockout plate 82. The installer then removes the appropriate positioning sections 90, 92, 94 or 96 (in the figures) to place port section 88 at a place that outlet 36 is in substantial alignment with the drainage pipe. For outlet 36 shown in FIG. 2, third 94 and fourth 96 positioning sections have been removed. First slide member 48 is then inserted at slide insert 56 into first slide opening 44 so that the slide edges 66 and 68 slidably engage the slide opening sides 52 and 54. First slide member 48 is slid up first slide opening 44 until the leading edge 60 abuts slide stop 58 and tab members 106 engage the bottom 16 of receptacle body 12. The installer then installs the desired outlet 36 onto first slide member 48. If catch basin 10 will also connect to an inlet pipe, the same process is repeated for inlet 34, as shown in the sequence of FIGS. 9 through 12, which illustrates first 90 and second 92 positioning sections having been removed to place inlet 34 near the collar 20 of receptacle body 12.

While there are shown and described herein a specific form of the invention, it will be readily apparent to those skilled in the art that the invention is not so limited, but is susceptible to various modifications and rearrangements in design and materials without departing from the spirit and scope of the invention. In particular, it should be noted that the present invention is subject to modification with regard to any dimensional relationships set forth herein and modifications in assembly, materials, size, shape, and use. For instance, there are numerous components described herein that can be replaced with equivalent functioning components to accomplish the objectives of the present invention.

What is claimed is:

1. A catch basin, comprising:

a receptacle body having a plurality of side walls, a bottom and an open top section, said receptacle body defining a fluid chamber therein;

a slide opening in at least one of said plurality of side walls, said slide opening comprising a pair of opposing slide opening sides;

a slide member sized and configured to be received in said slide opening, said slide member having a pair of slide edges, a leading edge, a trailing edge, an inner wall face and an outer wall face, said slide member configured to slidably engage said slide opening sides and substantially close said slide opening;

a port section on said slide member; and two or more removable positioning sections on said slide member, at least one of said positioning sections disposed above said port section and at least one of said positioning sections disposed below said port section, said positioning sections configured to selectively position said port section on said at least one of said plurality of side walls.

2. The catch basin according to claim 1, wherein said slide opening has a slide insert for receiving said slide member and a slide stop configured to abut against said leading edge of said slide member.

3. The catch basin according to claim 2, wherein said side walls are substantially vertical, said slide insert is at said bottom, said slide stop is near said peripheral collar and said slide opening sides extend upwardly from said slide insert to said slide stop.

4. The catch basin according to claim 1, wherein said plurality of side walls, said bottom and said top section are substantially contiguous and said receptacle body is a substantially unitary structure.

5. The catch basin according to claim 4, wherein said receptacle body is manufactured from a structural plastic material.

6. The catch basin according to claim 1, wherein said inner wall face of said slide member comprises a slide engagement member configured to slidably engage said slide opening sides.

7. The catch basin of according to claim 1, wherein said slide member frictionally engages said slide opening.

8. The catch basin according to claim 1, wherein said side edges of said slide member are received in a groove disposed in each of said slide opening sides.

9. The catch basin according to claim 1, wherein said port section of said slide member comprises a port.

10. The catch basin according to claim 9, wherein said port is a universal outlet.

11. The catch basin according to claim 9, wherein said port is integral with said slide member.

12. The catch basin according to claim 9, wherein said port is fixedly attached to said slide member.

13. The catch basin according to claim 1, wherein said port section of said slide member comprises means for attaching a port to said slide member.

14. The catch basin according to claim 1, wherein said port section of said slide member comprises a removable slide port cutout, said slide port cutout sized and configured to receivedly engage a port.

15. The catch basin according to claim 14, wherein said slide port cutout comprises one or more key ways sized and configured to cooperatively engage one or more keys on said port.

16. The catch basin according to claim 1, wherein at least one of said inner wall face and said outer wall face of said slide member has a section cut defining each of said positioning sections, said section cut comprising an area of reduced thickness configured to facilitate removal of at least one of said positioning sections from said slide member.

17. The catch basin according to claim 15, wherein at least one of said inner wall face and said outer wall face of said slide member comprises one or more section removal indicators configured to identify which of said positioning sections should be removed to obtain the desired placement of said port section on said at least one of said plurality of side walls.

18. A catch basin, comprising:

a unitary receptacle body having a plurality of substantially vertical side walls, a bottom and an open top section, said side walls, bottom and top section substantially contiguous and defining a fluid chamber in said receptacle body;

a slide opening in at least one of said plurality of side walls, said slide opening comprising a pair of opposing slide opening sides extending upwardly from a slide insert at said bottom to a slide stop near said peripheral collar;

a slide member received in said slide opening, said slide member having a pair of slide edges, a top edge, a bottom edge, an inner wall face and an outer wall face, said slide edges of said slide member frictionally engaged with said slide opening sides and said top edge of said slide member abutting said slide stop to substantially close said slide opening;

a port section on said slide member; and two or more removable positioning sections on said slide member, at least one of said positioning sections disposed above said port section and at least one of said positioning sections disposed below said port section, said positioning sections configured to selectively position said port section on said at least one of said plurality of side walls.

19. The catch basin according to claim 17, wherein said inner wall face of said slide member comprises a slide engagement member configured to slidably engage said slide opening sides.

20. The catch basin according to claim 17, wherein said side edges of said slide member are received in a groove disposed in each of said slide opening sides.

21. The catch basin according to claim 17, wherein said port section of said slide member comprises a port, said port integral with or fixedly attached to said slide member.

22. The catch basin according to claim 1, wherein said port section of said slide member comprises means for attaching a port to said slide member.

23. The catch basin according to claim 17, wherein said port section of said slide member comprises a removable slide port cutout, said slide port cutout sized and configured to receivedly engage a port.

24. The catch basin according to claim 17, wherein at least one of said inner wall face and said outer wall face of said slide member comprises a section cut defining each of said positioning sections and one or more section removal indicators, said section cut comprising an area of reduced thickness configured to facilitate removal of at least one of said positioning sections from said slide member, said section removal indicators configured to identify which of said positioning sections should be removed to obtain the desired placement of said port section on said at least one of said plurality of side walls.

25. A catch basin, comprising:

a receptacle body having a plurality of substantially vertical side walls, a bottom and an open top section, said receptacle body defining a fluid chamber therein, said plurality of side walls comprising at least a first side wall and a second side wall;

a first slide opening in said first side wall, said first slide opening comprising a pair of opposing slide opening sides extending upwardly from a slide insert at said bottom to a slide stop near said peripheral collar at said first side wall;

a first slide member received in said first slide opening, said first slide member having a pair of slide edges, a top edge, a bottom edge, an inner wall face and an outer wall face, said first slide member slidably engaged with said slide opening sides and abutting said slide stop of said first slide opening, said first slide member substantially closing said first slide opening; said first slide member further comprising a port section and two or more removable positioning sections, at least one of said positioning sections disposed above said port section and at least one of said positioning sections disposed below said port section, said positioning sections configured to selectively position said port section on said first side wall;

a second slide opening in said second side wall, said second slide opening comprising a pair of opposing slide opening sides extending upwardly from a slide insert at said bottom to a slide stop near said peripheral collar at said second side wall; and a second slide member received in said second slide opening, said second slide member having a pair of slide edges, a top edge, a bottom edge, an inner wall face and an outer wall face, said second slide member slidably engaged with said slide opening sides and abutting said slide stop of said second slide opening, said second slide member substantially closing said second slide opening; said second slide member further comprising a port section and two or more removable positioning sections, at least one of said positioning sections disposed above said port section and at least one of said positioning sections disposed below said port section, said positioning sections configured to selectively position said port section on said second side wall.

26. The catch basin according to claim 23 wherein said port section of said first slide member comprises an outlet attached to or integral with said first slide member and said port section of said second slide member comprises an inlet attached to or integral with said second slide member.

27. The catch basin according to claim 1, wherein said port section of each of said first slide member and said second slide member comprises means for attaching a port to said first slide member and said second slide member.

28. The catch basin according to claim 23, wherein said port section of at least one of said first slide member and said second slide member comprises a removable slide outlet cutout, said slide outlet cutout sized and configured to receivedly engage a port.

29. The catch basin according to claim 23, wherein at least one of said inner wall face and said outer wall face of each of said first slide member and said second slide member comprises a section cut defining each of said positioning sections and one or more section removal indicators, said section cut comprising an area of reduced thickness configured to facilitate removal of at least one of said positioning sections from each of said first slide member and said second slide member, said section removal indicators configured to identify which of said positioning sections should be removed to obtain the desired placement of said port section of said first slide member on said first side wall and said port section of said second slide member on said second side wall.

* * * * *